United States Patent [19]

Kubelka

[11] 4,138,828

[45] Feb. 13, 1979

[54] SKI BOOT

[75] Inventor: Axel R. Kubelka, Vienna, Austria

[73] Assignee: TMC Corporation, Baar, Switzerland

[21] Appl. No.: 813,328

[22] Filed: Jul. 5, 1977

[30] Foreign Application Priority Data

Jul. 21, 1976 [AT] Austria ..... 5353/76

[51] Int. Cl.[2] ..... A43B 5/04

[52] U.S. Cl. ..... 36/121

[58] Field of Search ..... 36/120, 121

[56] References Cited

U.S. PATENT DOCUMENTS 3,543,421 12/1970 Ader ..... 36/121

3,619,914 11/1971 Hanson et al. ..... 36/121

3,701,208 10/1972 Dalebout ..... 36/121

*Primary Examiner*—Patrick D. Lawson

*Attorney, Agent, or Firm*—Blanchard, Flynn, Thiel, Boutell & Tanis

[57] ABSTRACT

A ski boot having an ankle cuff which is movable relative to a lower shell about a transverse axis which is provided at approximately ankle height on the ski boot. A bar-like device is secured to and extends between the lower shell and the ankle cuff. A tensioning lever is provided to control the position of the bar-like device to regulate the extent of the relative movement between the ankle cuff and the lower shell.

11 Claims, 8 Drawing Figures

SKI BOOT

FIELD OF THE INVENTION

The invention relates to a ski boot, in which the upper part of the boot can be pivoted or can be bent relative to the lower part of the boot about a transversely extending axle or the like which is at approximately ankle height on the ski boot, wherein between the lower shell and the ankle cuff of the boot there is provided possibly a connection which determines the position of the ankle cuff of the boot with respect to the lower shell of the boot, and wherein the upper part of the boot has at its rear area an elongated bar member or the like, which in the downhill position rests directly on or by an interpositioning of an adjustable support member on the associated ski binding part, (or the support member is secured on the ski or on a ski-fixed part).

BACKGROUND OF THE INVENTION

A ski boot of the abovementioned type is described in my copending U.S. patent application Ser. No. 770 586, filed Feb. 22, 1977. The construction according to that disclosure has the purpose of overcoming disadvantages of earlier known constructions, which have been described for example in Swiss Pat. No. 512 204 and in Swiss Pat. No. 518 071. The known constructions have namely the disadvantage that they are not suited for walking or only through a complicated manipulation. The mentioned devices are thereby relatively complicated in relationship to the purpose which must be attained. Therefore, a further purpose of my earlier disclosure was to design an abovementioned ski boot such that the walking capability could be achieved with simple means.

The object of the present invention is to provide an improvement for my earlier solution. It is to be possible to be able to carry out the release from or locking to the ski binding by operation with one single handle.

In this connection it is also remarked that one embodiment according to Swiss Pat. No. 549 970 describes a ski boot having a lower shell of the boot and an ankle cuff of the boot which is secured hingedly to said lower shell of the boot, in which an adjusting device is provided with which the position of inclination of the ankle cuff of the boot can be adjusted and secured in relationship to the lower shell of the boot. This known construction therefore deals with a securing of the position between the ankle cuff of the boot and the lower shell of the boot, wherein the respective position of the ankle cuff of the boot with respect to the lower shell of the boot can be adjusted to the desired angle by the provided adjusting device. If, however, the adjusting device is set into the free position, then the ankle cuff of the boot cannot be moved into any certain support position in relationship to the ski binding.

The present invention will bring about an improvement also with respect to this known construction and will permit a free walking or walking capability of the ski boot even when same is held between the bindings on the ski.

The set purpose is attained inventively by providing an elongated bar which is connected to the ankle cuff of the boot by means of a tensioning lever which is hinged to said ankle cuff of the boot and is able to be adjusted between a locking and a releasing position, wherein the bar is guided by means of a guide element mounted adjacent the area of the lower shell of the boot.

The inventive construction of the ski boot eases — by adjusting the tensioning lever into the releasing position — walking or standing in the ski boot even when the ski boot is secured to the ski. Upon closing of the tensioning lever, the predetermined position of the ankle cuff of the boot in relationship to the lower shell of the boot is automatically brought about.

BRIEF DESCRIPTION OF THE DRAWINGS

Further advantages and details of the invention will now be described more in detail with reference to the drawings which illustrate several exemplary embodiments.

In the drawings:

FIGS. 1 to 3 illustrate three different embodiments of the inventive ski boot, wherein FIG. 1 and FIG. 3 each illustrate a closed position

DETAILED DESCRIPTION

Figure 1:
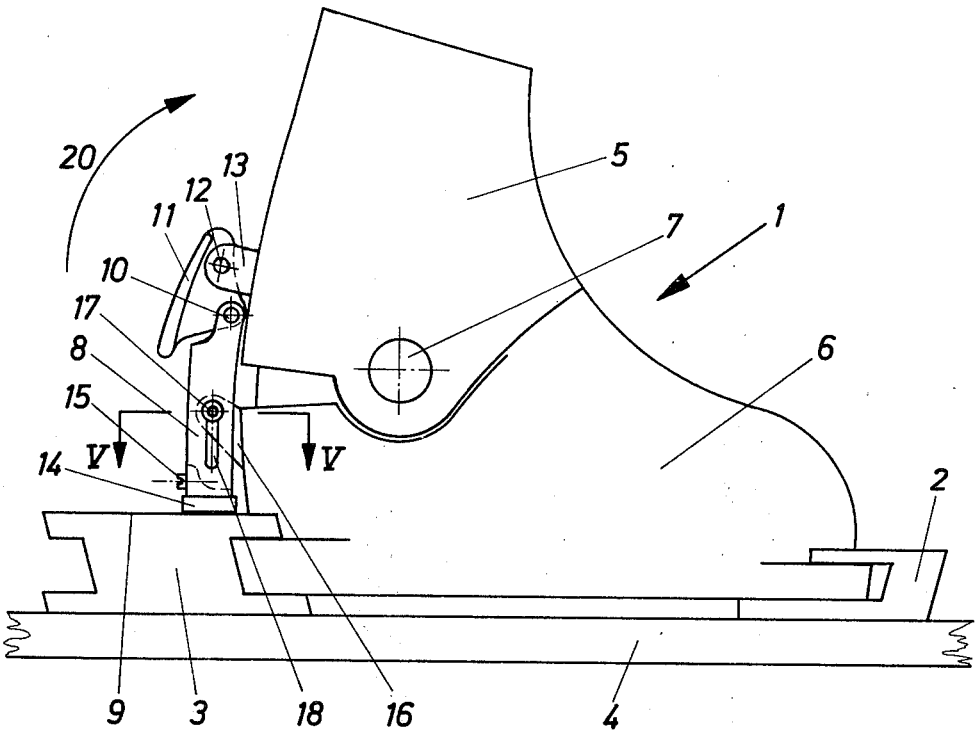

The same component parts of the structure shown in the drawings have corresponding reference numerals; differently constructed parts which serve the same purpose have been given the same reference numerals but with the prime (') suffix added to effect a differentiation.

All embodiments have in common a two-part ski boot 1 which is held on a ski 4 by means of two horizontally spaced ski binding parts 2 and 3. The two-part ski boot 1 has an upper part or ankle cuff 5 and a lower part or lower shell 6 which are pivotally connected by means of a transversely extending axle mechanism 7 which is positioned approximately at ankle height on the ski boot.

Figure 6:
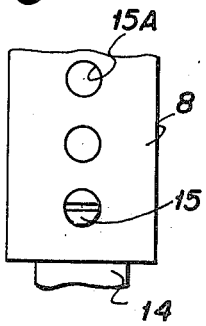
FIG. 6 is a view taken along the line VI—VI in FIG. 5.
Figure 7:
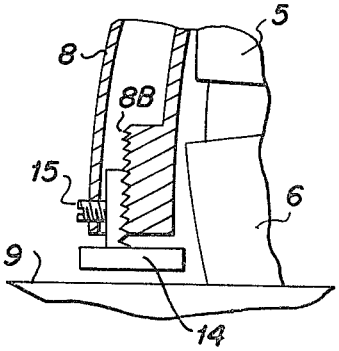
FIG. 7 is a fragmentary sectional view of a further modified embodiment.
Figure 5:
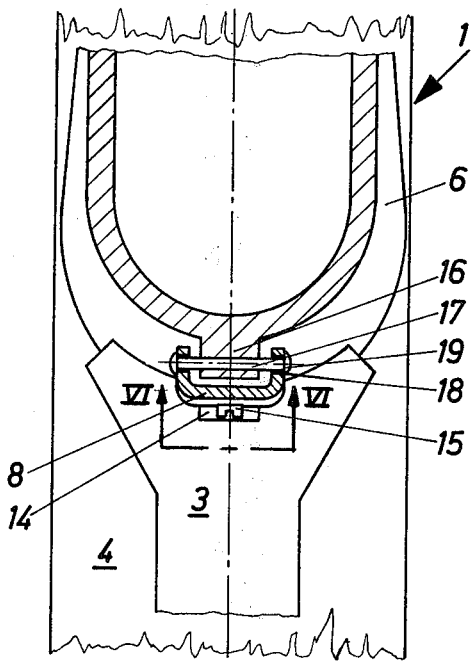
FIG. 5 is a cross-sectional view taken along the line V—V of FIG. 1.

In the first exemplary embodiment according to FIGS. 1 and 5, an elongated bar 8 is constructed in the form of a profile, which as shown in FIG. 5 is approximately C-shaped in cross section. The bar 8 is pivotally connected at its upper end by means of a pivot axis 10 to a tensioning lever 11, which is in turn pivotally connected through a further transversely extending axle 12 to a support block 13 fixedly connected to the rear surface of the ankle cuff 5 of the boot. An insert plate 14 is secured to the bar 8 adjacent the lower end thereof, which end or insert plate 14 cooperates with the rear binding part 3. The position of the insert plate 14 relative to the bar 8 can be adjusted by means of a suitable setting member, for example a setscrew 15 received in a selected one of a plurality of threaded openings 15A (FIG. 6). In addition, the bar 8 can have teeth 8B (FIG. 7) thereon engageable with mating teeth on the insert plate and held together by the screw 15. This adjustment will effect an alteration in elevational direction at the rear part of the bar 8 to compensate for different heights in binding parts 3. The adjustment must be carried out in each case so that the lower side of the insert plate 14 fixedly rests under tension in the closed position of the tensioning lever 11 on the upper surface 9 of the binding part 3.

A mounting member 16 is mounted on the lower shell 6 of the boot and has a fixedly positioned, transversely extending bolt 17 thereon with ends which project outwardly from both sides thereof. The transverse bolt 17 extends on said both sides through slots 18 in the legs of the C-shaped bar 8 which extend in vertical direction. The bar 8 is stationarily held on the two outer ends of the bolt 17 to prevent a lateral shifting by means of lockwashers 19.

In the closed position of the tensioning lever 11, which is shown in FIG. 1, the bar 8 rests under tension on the surface (upper surface) 9 of the binding part 3. If the tensioning lever 11 is swung in direction of the arrow 20 according to FIG. 1 in a clockwise direction, then the forwardly pivoted position, that is the rearward limit of the pivotal connection of the ankle cuff 5 in relationship to the lower shell 6 of the ski boot 1, is cancelled and a position for the bar 8 is created, as it is shown approximately in FIG. 2A. It becomes thereby unimportant that in FIG. 2, as will be discussed hereinafter, a second embodiment is illustrated.

Figure 2A:
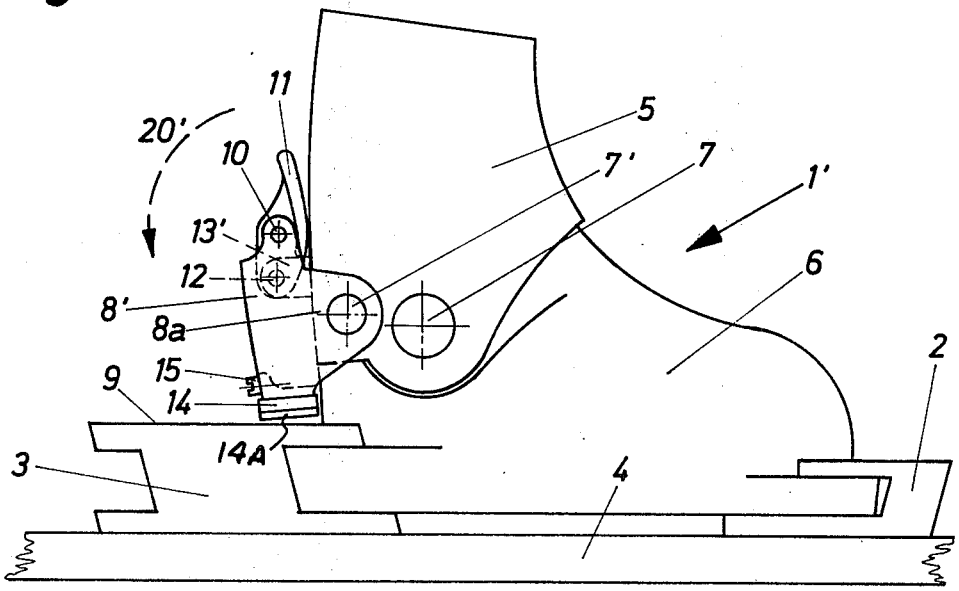
FIG. 2A illustrates an open position of a modified embodiment and FIG. 2B illustrates an open position of a further modified embodiment.
Figure 2B:
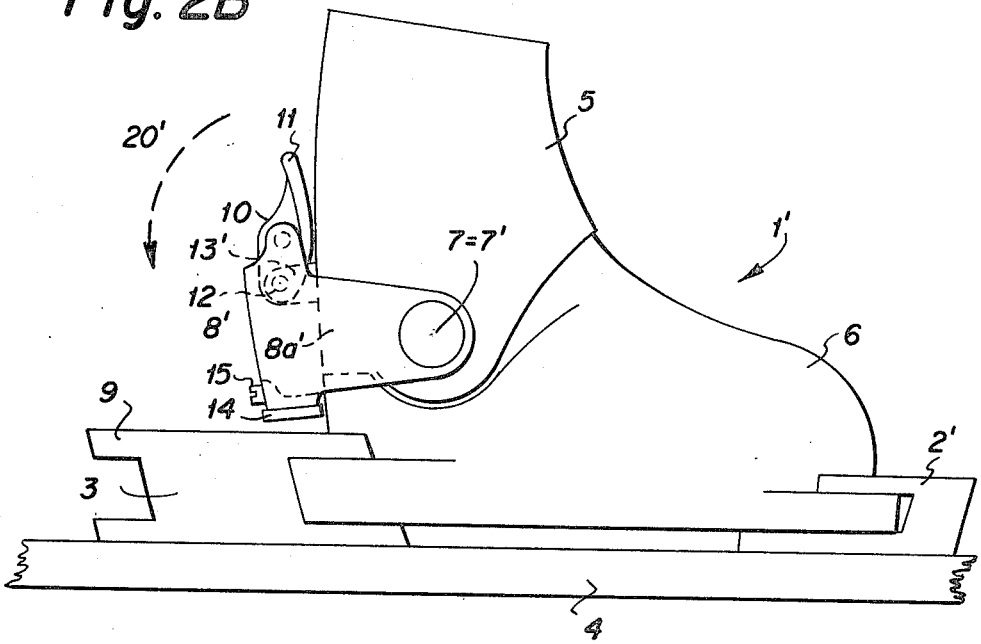

In a second embodiment according to FIG. 2A, the bar 8' is pivotally supported through a transversely extending axle which is formed by bolts 7' on the ankle cuff 5 of the boot. In a third exemplary embodiment of FIG. 2B, the transverse axle 7 is positioned as shown in the second embodiment of FIG. 2*a*, however, the transverse axles 7 and 7' are common to each other, namely the ankle cuff 5, the lower shell 6 of the boot and the bar 8' are all pivotal about the transverse axle 7. As a result the guide of bar 8' in the area of the lower shell 6 of the boot is provided by a connecting element 8*a* on the bar 8'. Fastening of the upper end of the bar 8' corresponds substantially to the one which has already been described with reference to FIG. 1. Since in the present embodiment the open position has been illustrated, the tensioning lever 11 must be operated counter-clockwise in direction of the dashed arrow 20' for closing.

Figure 3:
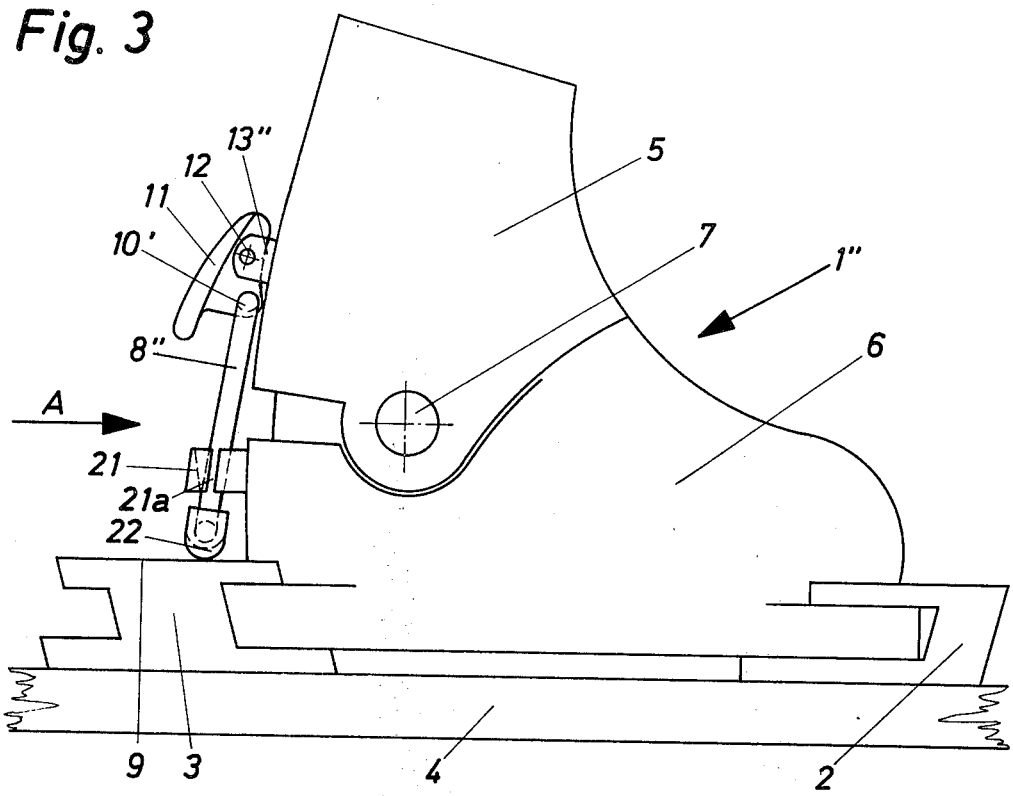
Figure 4:
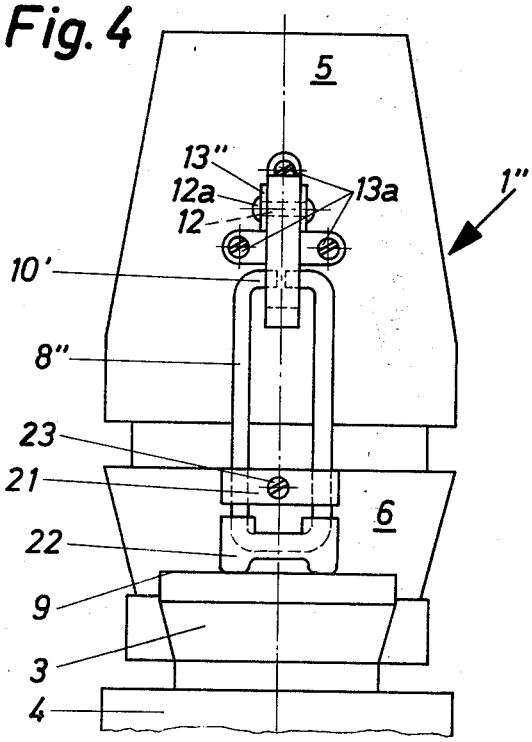
FIG. 4 is a rear view of the ski boot taken in direction of the arrow A in FIG. 3.

FIGS. 3 and 4 illustrate a further embodiment, wherein the bar 8'', as can better be recognized from FIG. 4, is constructed in the form of a double U-shaped linkage. Fastening at the upper end of the bar 8'' corresponds substantially to the embodiment according to FIG. 1 with the difference, that the transverse axle 10' is formed by the inwardly bent free ends of the bar 8'' or the like. From FIG. 4 one will recognize that the support block 13'' is secured by means of holding screws 13*a* to the rear part of the ankle cuff 5 of the boot. Enlarged heads 12*a* are utilized on the transverse axle 12 to secure the position of the transverse axle 12 in relationship to the support block 13''.

To guide the bar 8'' adjacent the lower shell 6*a* of the boot, a guide block 21 is mounted thereon which is provided with laterally spaced openings for guiding the two legs of the bar 8''. A support piece 22 is mounted on the lower end of the bar 8'' and transmits the necessary tension from the tensioning lever 11 onto the upper surface 9 of the rear binding part 3.

For the purpose of indicating the different embodiments of the bars 8, 8' and 8'' according to the embodiments of FIGS. 1, 2A, 2B or 3, respectively, the associated ski boot has been given the reference numerals 1, 1' or 1'', respectively. Since other parts of the ski boot can be substantially corresponding, even in the case of certain changes of individual parts, a difference in the ski boot construction was not emphasized.

The invention is not limited to the illustrated exemplary embodiments. Additional various modifications are conceivable without departing from the scope of the invention. For example, a similar support piece as was shown and described with reference to the embodiment according to FIGS. 3 and 4 can also be used in the embodiment according to FIGS. 1 or 2. However, adjustment can also be done differently, for example the insert plate may have at its upwardly extending extension part teeth which fit into teeth of the inside of the bar 8 and cooperate with said first-mentioned teeth and can be secured in the respective position by means of a screw. In this case, the screw is a stationary member and is not constructed as a setscrew. The insert plate or the support piece can have on the side which faces the upper surface 9 of the ski binding part 3 a layer 14*a* (FIG. 2*a*) of a slightly elastic material which has no influence on the tensioning action of the tensioning lever, however, balances out or equalizes vibrations.

Even though the exemplary embodiments show a ski boot, the ankle cuff and lower shell of which are connected by means of a pivot axle construction, it is easily conceivable to realize the device in the case of a boot according to my aforementioned application Ser. No. 770 586 in which the ankle cuff of the boot can be pivoted relative to the lower shell of the boot by using a bellows construction.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a combination of a ski boot and a ski binding, said ski boot having a lower shell and an ankle cuff pivotally secured to said lower shell to allow pivotal movement of said ankle cuff about a first pivot axis in response to shifts in the weight of an individual using said ski boot, said ski binding including at least a heel holder engaging the heel portion of said ski boot to hold said heel portion to a ski, said ankle cuff having support means extending rearwardly therefrom and including first means thereon defining a downwardly facing first surface, said heel holder including second means defining an upwardly facing second surface, said first surface directly engaging said second surface to limit the amount of pivotal movement of said ankle cuff to the rear of said lower shell, the improvement comprising wherein said first means includes a tensioning lever pivotally secured to said support means about a second pivot axis and an elongated bar pivotally secured to said tensioning lever about a third pivot axis spaced from said second pivot axis, said tensioning lever being pivotal between first and second positions, said elongated bar having a sufficient length to extend to and effect an engagement of said downwardly facing first surface with said upwardly facing second surface when said tensioning lever is in said first position to thereby limit the extent to which said ankle cuff can pivot rearwardly relative to said lower shell, said first surface being raised above said second surface a predetermined distance in response to a pivotal movement of said tensioning lever to said second position to thereby permit a rearward pivotal movement of said ankle cuff relative to said lower shell while said ski boot remains coupled to said ski bindings, said first means further including guide means operatively connected to said bar and said lower shell for guiding said bar for movement in response to the pivotal movement of said tensioning lever.

2. The improved ski boot according to claim 1, wherein said guide means includes a pivotal support for said bar to facilitate said pivotal movement of said ankle cuff relative to said lower 3. The improved ski boot according to claim 1, wherein said first and second pivot axes are spaced and separate.

4. The improved ski boot according to claim 1, wherein said first and second pivot axes are coaxial.

5. The improved ski boot according to Claim 1, wherein said second and third pivot axes extend parallel to each other and to said first pivot axis.

6. The improved ski boot according to Claim 1, wherein said bar is C-shaped in cross section with a pair of opposed legs, wherein said guide means includes means defining longitudinal slots in both legs, a mounting member secured to said lower shell of said ski boot, and a transversely extending bolt extending through said slot, said bolt being stationarily supported in said mounting member.

7. The improved ski boot according to Claim 1, wherein said bar is a generally U-shaped linkage having a pair of legs, the free ends of which are bent inwardly and connected to said tensioning lever at said second pivot axis, wherein said guide means includes a mounting member secured to said lower shell of said ski boot, said mounting member having recesses therein for receiving the legs of said linkage, and wherein said linkage has a support piece at the lower end thereof having said downwardly facing first surface thereon.

8. The improved ski boot according to claim 1, wherein said bar has an insert plate secured to the end thereof remote from said second pivot axis and adjustment means for facilitating an adjustment in the relative position between said insert plate and said bar.

9. The improved ski boot according to claim 8, wherein said adjustment means includes a setscrew which can be inserted at least steplike in corresponding receiving points of said bar.

10. The improved ski boot according to claim 8, wherein said insert plate has teeth thereon engaged with associated teeth on said bar and secured in this position by means of a fixing screw.

11. The improved ski boot according to claim 1, wherein said downwardly facing first surface has a slightly elastic material layer thereon.

* * * * *

UNITED STATES PATENT AND TRADEMARK OFFICE

CERTIFICATE OF CORRECTION

PATENT NO. : 4 138 828

DATED : February 13, 1979

INVENTOR(S) : Axel R. Kubelka

It is certified that error appears in the above-identified patent and that said Letters Patent are hereby corrected as shown below:

Column 5, line 6; after "lower" insert ---shell.---.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*